US012427437B2

(12) United States Patent
Li

(10) Patent No.: US 12,427,437 B2
(45) Date of Patent: Sep. 30, 2025

(54) DEPLOYABLE TOY TRANSPORT VEHICLE

(71) Applicant: Shenzhen Sichuang Liwei Technology Co., Ltd., Shenzhen (CN)

(72) Inventor: Jing Li, Shenzhen (CN)

(73) Assignee: Shenzhen Sichuang Liwei Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/814,407

(22) Filed: Aug. 23, 2024

(65) Prior Publication Data

US 2025/0050234 A1 Feb. 13, 2025

(51) Int. Cl.

| | |
|---|---|
| ***A63H 17/05*** | (2006.01) |
| ***A63H 17/26*** | (2006.01) |
| ***A63H 17/28*** | (2006.01) |
| ***A63H 18/02*** | (2006.01) |

(52) U.S. Cl.

CPC ..... *A63H 17/05* (2013.01); *A63H 17/268* (2013.01); *A63H 17/28* (2013.01); *A63H 18/02* (2013.01)

(58) Field of Classification Search

CPC ..... A63H 17/05; A63H 18/02

See application file for complete search history.

(56) References Cited

U.S. PATENT DOCUMENTS

| | | | | |
|---|---|---|---|---|
| 4,505,686 | A * | 3/1985 | Mariol | A63H 33/003 446/478 |
| 4,708,683 | A * | 11/1987 | Lehmann | A63H 17/05 446/434 |
| 4,717,367 | A * | 1/1988 | Stubenfoll | A63H 33/003 446/457 |
| 4,889,515 | A * | 12/1989 | Auer | A63H 31/00 446/470 |
| 6,520,829 | B1 * | 2/2003 | Temple | A63H 17/26 446/434 |
| 7,442,109 | B2 * | 10/2008 | Fosbenner | A63H 17/08 446/451 |
| 7,722,430 | B2 * | 5/2010 | Hippely | A63H 17/004 446/431 |
| 11,498,012 | B2 * | 11/2022 | Hwang | A63H 17/008 |
| 11,957,992 | B1 * | 4/2024 | Hwang | A63H 17/06 |
| 2005/0106993 | A1 * | 5/2005 | Fosbenner | A63H 17/38 446/330 |
| 2008/0009219 | A1 * | 1/2008 | Nuttall | A63H 18/06 446/435 |

(Continued)

FOREIGN PATENT DOCUMENTS

| | | | |
|---|---|---|---|
| CN | 204159028 U | | 2/2015 |
| CN | 206526511 U | * | 9/2017 |

(Continued)

*Primary Examiner* — Eugene L Kim
*Assistant Examiner* — Alyssa M Hylinski

(57) ABSTRACT

Provided is a deployable toy transport vehicle, which comprises a cab portion and a trailer portion, the trailer portion comprises a vehicle seat, a middle carriage and a vehicle roof which are slidably connected in a pulling manner, the vehicle seat, the middle carriage and the vehicle roof are unfolded into a linear runway by pulling the middle carriage and the vehicle roof, connectors are arranged at rear ends of the vehicle seat and the middle carriage and are used for guiding the middle carriage and the vehicle roof to translate horizontally and vertically, and the cab portion is provided with a transmitter of a toy trolley.

7 Claims, 8 Drawing Sheets

(56) References Cited

U.S. PATENT DOCUMENTS

| | | | | |
|---|---|---|---|---|
| 2012/0129424 | A1* | 5/2012 | Payne | A63H 18/00<br>446/476 |
| 2014/0256219 | A1* | 9/2014 | Lennon | A63H 17/008<br>446/429 |

FOREIGN PATENT DOCUMENTS

| | | | |
|---|---|---|---|
| CN | 216536887 U | * | 5/2022 |
| CN | 218357340 U | | 1/2023 |

* cited by examiner

DEPLOYABLE TOY TRANSPORT VEHICLE

TECHNICAL FIELD

The present invention relates to the technical field of toy vehicles, and particularly to an automatic transport trailer and a transport vehicle for a toy trolley.

BACKGROUND OF THE PRESENT INVENTION

Toy vehicles have always been loved by children. At present, there are various forms of toy vehicles on the market, such as the toy vehicles that can be assembled into a runway and the transport vehicle can be used for storing a toy trolley. However, for the runway type toy vehicle, the runway is troublesome to assemble, at the same time, many parts are easy to be lost, and the runway takes up space, which is not conducive to being placed in a house; but the storage type transport vehicle has a single structure and weak playability. Therefore, it is necessary to design a deployable toy transport vehicle, which can not only facilitate the assembly of the runway, but also provide various forms to improve the fun of the toy transport vehicle.

SUMMARY OF THE PRESENT INVENTION

The present invention provides a deployable toy transport vehicle, which solves problems that in the prior art, a runway is troublesome to assemble and occupies space, and at the same time, many parts are easy to be lost; however, the storage type transport vehicle has a single structure, weak playability and other problems. The scheme of the present invention for solving the technical problems is as follows: the deployable toy transport vehicle comprises a cab portion and a trailer portion, the trailer portion comprises a vehicle seat, a middle carriage and a vehicle roof, the vehicle seat, the middle carriage and the vehicle roof are slidably connected with each other in a pulling manner, and the cab portion comprises a transmitter of a toy trolley; wherein the toy transport vehicle is switched in a transport mode and a runway mode by pulling the middle carriage and the vehicle roof, the vehicle seat, the middle carriage and the vehicle roof are orderly stacked from bottom to top in the transport mode; and the vehicle seat, the middle carriage and the vehicle roof are connected end to end in the runway mode and are unfolded into a linear runway.

Preferably, the middle carriage comprises at least one carriage, and each carriage is slidably connected therebetween.

Preferably, connectors are arranged at rear ends of the vehicle seat and the middle carriage, the middle carriage is slidably connected with the connector arranged on the vehicle seat, and the vehicle roof is slidably connected with the connector arranged on the middle carriage; wherein, the connectors are used for guiding the middle carriage and the vehicle roof to translate horizontally and vertically.

Preferably, the connector comprises a lower horizontal chute, an upper horizontal chute and a vertical chute, and the vertical chute is communicated with the lower horizontal chute and the upper horizontal chute.

Preferably, a first horizontal sliding bar and a first vertical sliding block are arranged on a side wall of the middle carriage, and the first vertical sliding block is located at a front end of the middle carriage; a second horizontal sliding bar and a second vertical sliding block are arranged on a side wall of the vehicle roof, and the second vertical sliding block is located at a front end of the vehicle roof; when the toy transport vehicle is in the transport mode, the first horizontal sliding bar and the second horizontal sliding bar are slidably connected with the lower horizontal chute of the connector at corresponding positions; the first vertical sliding block and the second vertical sliding block are slidably connected with the upper horizontal chute of the connector at the corresponding positions; and when the toy transport vehicle is in the runway mode, the first vertical sliding block and the second vertical sliding block slide into the vertical chute of the connector at the corresponding positions.

Preferably, one connector is respectively arranged on both a left side and a right side of the vehicle seat and the middle carriage, the first horizontal sliding bar and the first vertical sliding block are symmetrically arranged on both a left side wall and a right side wall of the middle carriage; and the second horizontal sliding bar and the second vertical sliding block are symmetrically arranged on the side wall of the vehicle roof.

Preferably, wheels are arranged at bottoms of the cab portion and the trailer portion.

Preferably, the cab portion is in a shape of a dinosaur head, eyes of the dinosaur head are provided with luminous pieces, a top of the dinosaur head is provided with a sounding piece, a mouth of the dinosaur head is provided with an entrance, a channel is arranged at the bottom of the vehicle seat, and the entrance is communicated with the channel.

Preferably, the transmitter comprises a press head, a trigger plate and a spring, the press head is arranged at the top of the dinosaur head, the trigger plate is arranged at the front of the vehicle seat, one end of the spring is fixedly connected with the vehicle seat, and the other end thereof is connected with the trigger plate, and a bottom of the press head is connected with the trigger plate in a clamping manner.

Preferably, the vehicle roof comprises a top carriage, a second extension plate and a third extension plate which are hinged with each other end to end, the second horizontal sliding bar and the second vertical sliding block are arranged on a side wall of the top carriage; and the second extension plate is provided with a handle.

The present invention has the beneficial effect. The present invention provides the deployable toy transport vehicle, which has the advantages as follows:

1. The vehicle seat, the middle carriage and the vehicle roof are slidably connected with each other in the pulling manner, the vehicle seat, the middle carriage and the vehicle roof are orderly stacked from bottom to top in the transport mode; the vehicle seat, the middle carriage and the vehicle roof are connected end to end in the runway mode and are unfolded into the linear runway; the toy transport vehicle can be switched between the transport mode and the runway mode by pulling the middle carriage and the vehicle roof, and then the toy runway can be assembled by a single operation, which will not lose the parts of the toy runway; in addition, after the transport vehicle is switched into the transport mode, the vehicle seat, the middle carriage and the vehicle roof are stacked up and down to save space and facilitate storage.
2. The connectors are arranged at the rear ends of the vehicle seat and the middle carriage, the middle carriage is slidably connected with the connector arranged on the vehicle seat, and the vehicle roof is slidably connected with the connector arranged on the middle carriage, and the middle carriage and the vehicle roof are guided by the connectors to translate horizontally and vertically, which realizes that the toy transport vehicle is switched between the transport mode and the runway mode.

3. The cab portion is set in the shape of the dinosaur head, the eyes of the dinosaur head are provided with the luminous pieces, the top of the dinosaur head is provided with the sounding piece, the mouth of the dinosaur head is provided with the entrance, the channel is arranged at the bottom of the vehicle seat, and the entrance is communicated with the channel. By pushing the toy transport vehicle, the toy trolley enters from the entrance and then slides out from the channel, which simulates a state that the dinosaur head devours the trolley, and thus providing various ways of playing for the toy transport vehicle and improving the fun.

The above description is only an overview of the technical solution of the present invention. In order to clearly understand the technical means of the present invention and implement according to the contents of the specification, a detailed description of the preferred embodiment of the present invention is as follows with the drawings. The detailed description of preferred embodiments of the present invention are given in detail by the following embodiments and their drawings.

DESCRIPTION OF THE DRAWINGS

The drawings illustrated herein are used for providing a further understanding of the present invention and constitute a part of the present invention. The illustrative embodiments of the present invention and descriptions thereof are used to explain the present invention and do not constitute an undue limitation of the present invention. In the drawings.

Figure 1:
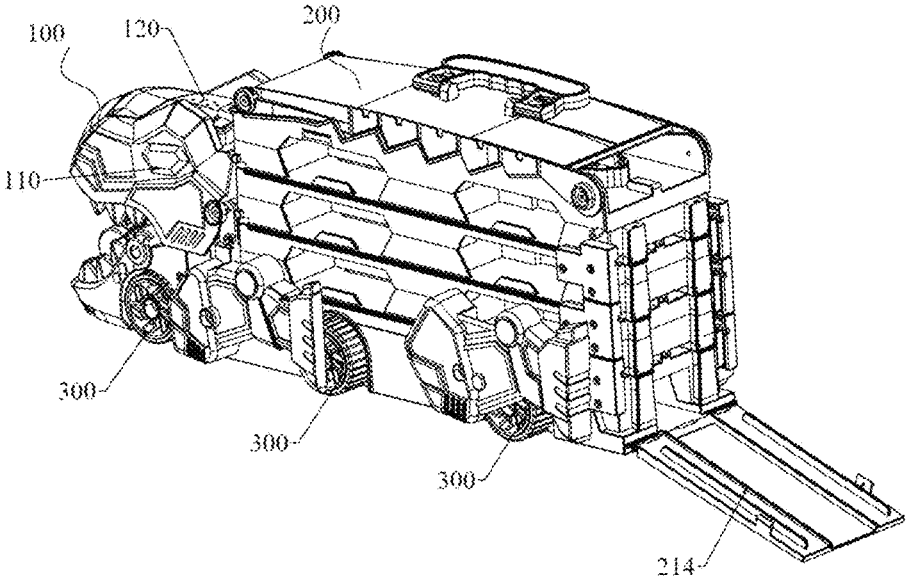
FIG. 1 is a schematic diagram of an overall structure of a toy transport vehicle in a transport mode according to the present invention.

In the drawings, the list of components represented by each reference number is as follows:

100 refers to cab portion; 110 refers to luminous piece; 120 refers to sounding piece; 130 refers to transmitter; 131 refers to press head; 132 refers to trigger plate; 133 refers to spring; 140 refers to entrance;

200 refers to trailer portion; 210 refers to vehicle seat; 211 refers to first chute; 212 refers to first bump; 213 refers to channel; 214 refers to tail plate;

220 refers to middle carriage; 220*a* refers to first carriage; 220*b* refers to second carriage; 221 refers to second chute; 222 refers to second bump; 223 refers to first slot; 224 refers to first horizontal sliding bar; 225 refers to first vertical sliding block; 226 refers to first cavity; 227 refers toe first sliding rail;

230 refers to vehicle roof; 231 refers to top carriage;

232 refers to second horizontal sliding bar; 233 refers to second cavity; 234 refers to handle; 235 refers to second sliding rail; 236 refers to second vertical sliding block;

237 refers to second slot; 238 refers to second extension plate; 239 refers to third extension plate;

300 refers to wheels;

400 refers to runway; 410 refers to left runway; 420 refers to right runway; and

500 refers to connectors; 501 refers to lower horizontal chute; 502. refers to upper horizontal chute; and 503 refers to vertical chute.

DETAILED DESCRIPTION OF PREFERRED EMBODIMENTS

The principles and features of the present invention are described below in conjunction with FIG. 1 to FIG. 17, and the examples given are only for explaining the present invention, not for limiting the scope thereof. In the following paragraphs, the present invention will be described in more detail by way of example with reference to the drawings. Advantages and features of the present invention will become more apparent according to the following description and claims. It should be noted that all the drawings are in a very simplified form and use inaccurate proportions, which are only used to facilitate and clearly illustrate the purpose of the embodiments of the present invention.

It should be noted that when a component is referred to be "fixed" to another component, the component can be directly on another component or can be the component in the middle. When one component is considered to be "connected" to another component, the component can be directly connected to another component or may be the component in the middle at the same time. When one component is considered to be "set on" another component, the component can be directly set on another component or may be the component in the middle at the same time. The terms "vertical", "horizontal", "left" and "right" and similar expressions used in the specification are for the purpose of illustration only.

Unless otherwise defined, all technical and scientific terms used herein have the same meaning as commonly understood by those skilled in the technical field of the present invention. The terms used in the specification of the present invention herein are only for the purpose of describing specific embodiments, and is not intended to limit the present invention. The terms "and/or" as used herein include any and all combinations of one or more related listed items.

Embodiment 1

The present invention provides a deployable toy transport vehicle, and FIG. 1 to FIG. 17 show that the toy transport vehicle can be constructed in two modes, namely a transport mode and a runway mode, so as to provide children with different play experiences.

FIG. 1 shows the toy transport vehicle in the transport mode. The toy transport vehicle comprises a cab portion 100 and a trailer portion 200, wherein the cab portion 100 is a headstock and the trailer portion 200 is a tailstock which can be used for storing a plurality of toy trolleys; wheels 300 are arranged at bottoms of the cab portion 100 and the trailer portion 200, respectively, so as to allow the toy transport vehicle to be rolled and pushed.

Figure 16:
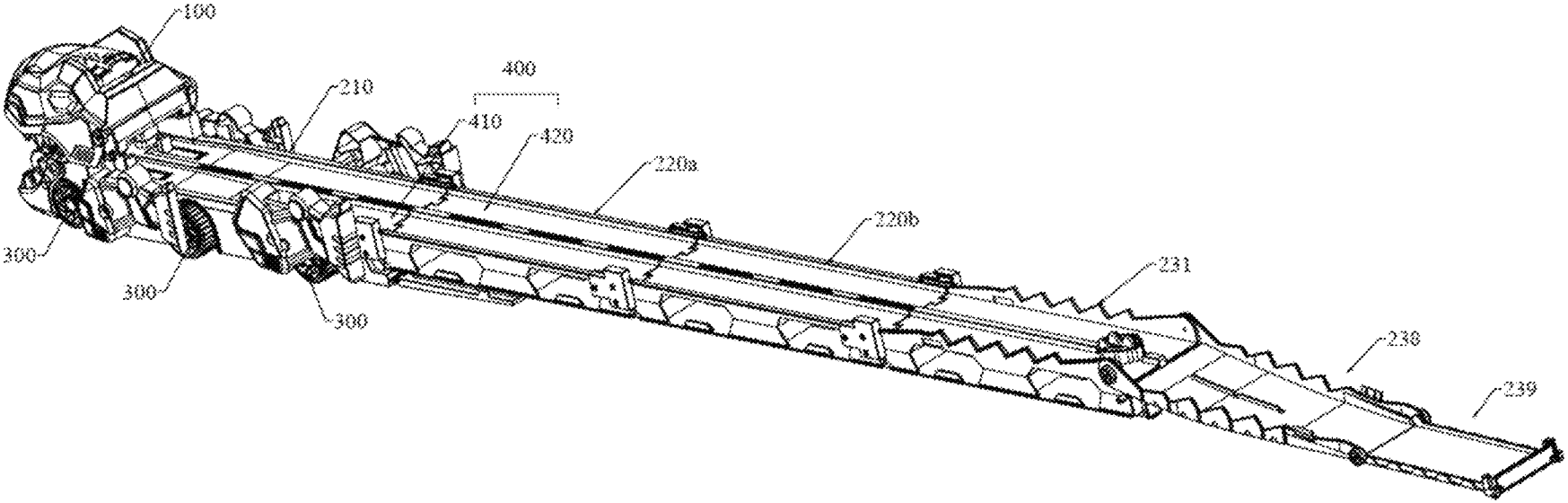
FIG. 16 is a schematic structural diagram of a runway mode of the toy transport vehicle according to the present invention.

As shown in FIG. 2 to FIG. 5, the trailer portion 200 comprises a vehicle seat 210, a middle carriage 220 and a vehicle roof 230, which are slidably connected with each other in a pulling manner. The toy transport vehicle can be switched between the transport mode and the runway mode by pulling the middle carriage 220 and the vehicle roof 230. The vehicle seat 210, the middle carriage 220 and the vehicle roof 230 are orderly stacked from bottom to top in the transport mode, the middle carriage 220 and the vehicle roof 230 serve the purpose of storing the toy trolley, and a tail of the vehicle seat 210 is hinged with a tail plate 214; the vehicle seat 210, the middle carriage 220 and the vehicle roof 230 are connected end to end in the runway mode, and are unfolded into a linear runway 400 (which is realized by pulling the middle carriage 220 and the vehicle roof 230). The cab portion 100 comprises a transmitter 130 of the toy trolley, and the transmitter is used for providing power for the trolley to run on the runway 400. As shown in FIG. 16, the runway 400 comprises a left runway 410 and a right runway 420. The transmitter 130 triggers the toy trolleys located on the left runway 410 and the right runway 420 at the same time, so that the two toy trolleys can compete to improve the fun of play.

In order to flexibly control the storage capacity of the trailer or lengthen a length of the runway 400, the middle carriage 220 is set to comprise at least one carriage, and each carriage is slidably connected with each other; for example, the middle carriage 220 comprises a first carriage 220*a* and a second carriage 220*b*. The first carriage 220*a* and the second carriage 220*b* have exactly the same structure, and are slidably connected with each other. Connectors 500 are arranged at rear ends of the first carriage 220*a* and the second carriage 220*b*.

Figure 8:
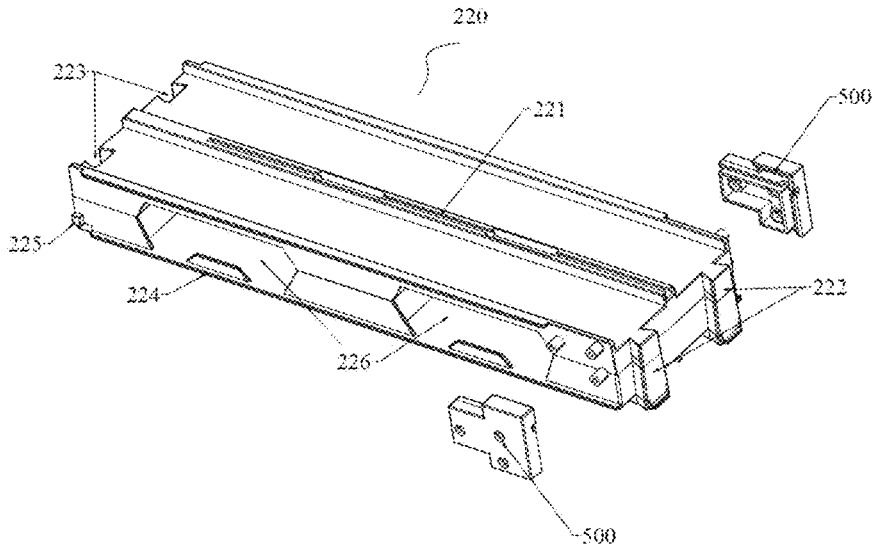
FIG. 8 is a schematic diagram of the explosion structure of a middle carriage and connectors of the toy transport vehicle according to the present invention.
Figure 9:
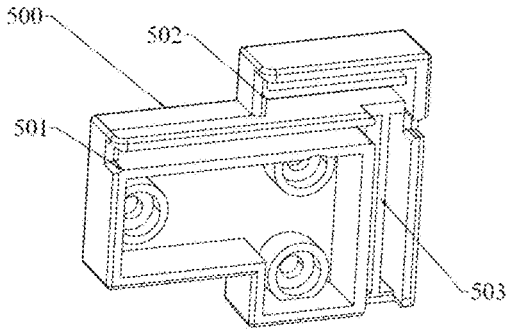
FIG. 9 is a schematic structural diagram of the connector of the toy transport vehicle according to the present invention.
Figure 10:
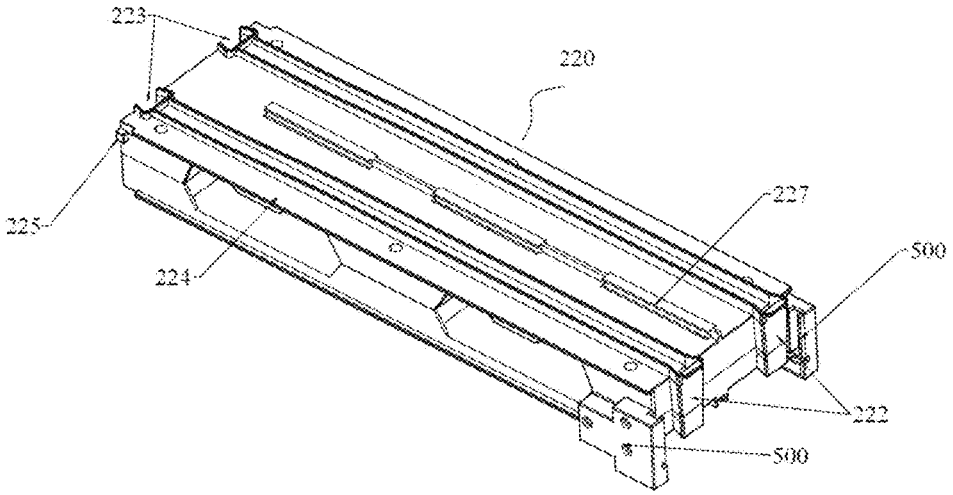
FIG. 10 is a schematic structural diagram of the connector of the toy transport vehicle according to the present invention.
Figure 11:
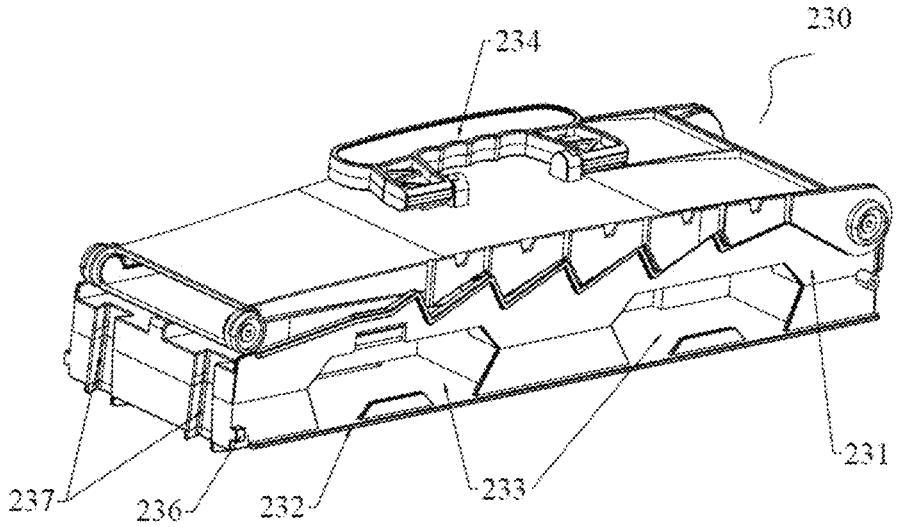
FIG. 11 is a schematic structural diagram of a vehicle roof of the toy transport vehicle according to the present invention.
Figure 12:
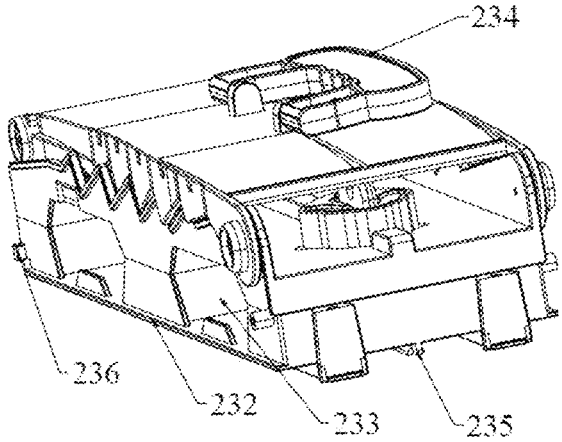
FIG. 12 is another structural schematic diagram of the vehicle roof of the toy transport vehicle according to the present invention.
Figure 13:
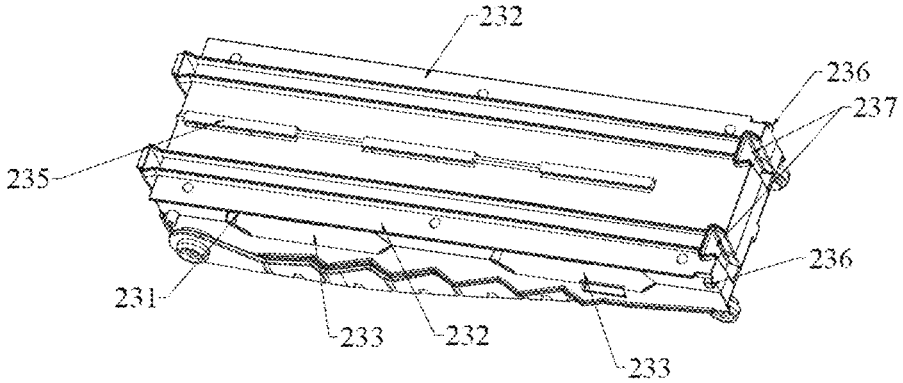
FIG. 13 is another schematic structural diagram of the vehicle roof of the toy transport vehicle according to the present invention.
Figure 14:
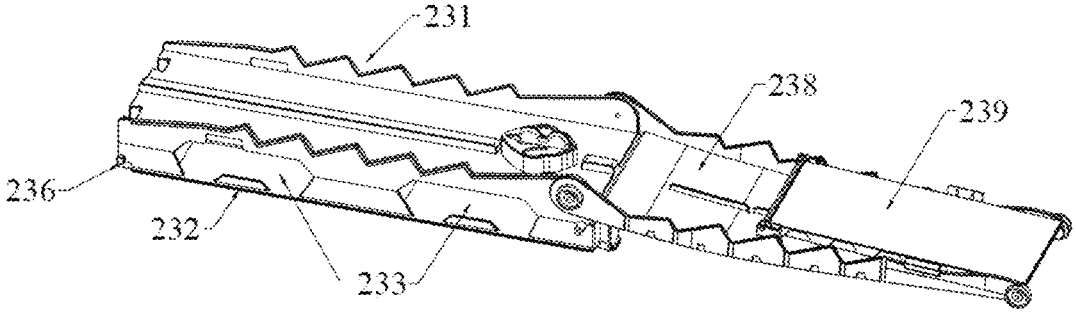
FIG. 14 is a schematic diagram of a deployed structure of the vehicle roof of the toy transport vehicle according to the present invention.
Figure 15:
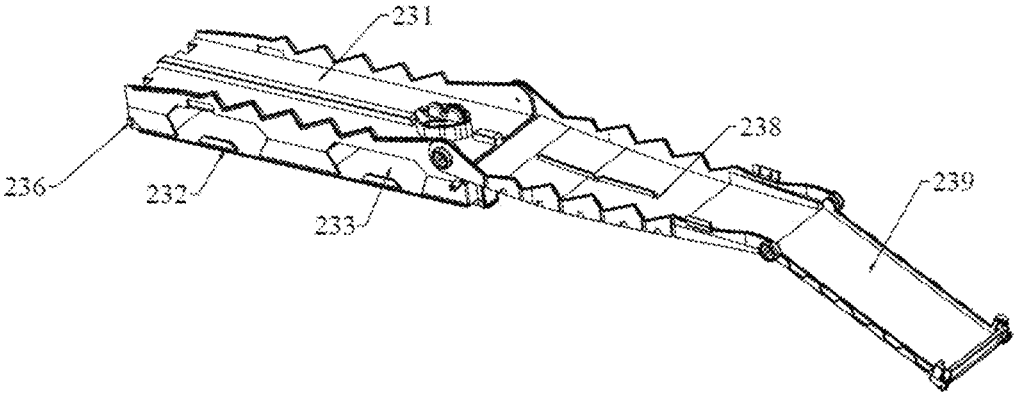
FIG. 15 is another schematic diagram of the deployed structure of the vehicle roof of the toy transport vehicle according to the present invention.

The vehicle seat 210, the middle carriage 220 and the vehicle roof 230 are slidably connected in a pulling manner through the connectors 500. As shown in FIG. 6 to FIG. 10, the connectors 500 are arranged at the rear ends of the vehicle seat 210 and the middle carriage 220, the middle carriage 220 is slidably connected with the connector 500 arranged on the vehicle seat 210, and the vehicle roof 230 is slidably connected with the connector 500 arranged on the middle carriage 220. As shown in FIG. 8 and FIG. 9, the connector 500 comprises a lower horizontal chute 501, an upper horizontal chute 502 and a vertical chute 503, and the vertical chute 503 is communicated with the lower horizontal chute 501 and the upper horizontal chute 502; and the connector 500 is used for guiding the middle carriage 220 and the vehicle roof 230 to translate horizontally and vertically.

A first horizontal sliding bar 224 and a first vertical sliding block 225 are arranged on the side wall of the middle carriage 220, the first horizontal sliding bar 224 is located at a lower part of the middle carriage 220, and the first vertical sliding block 225 is located at a front end of the middle carriage 220; a second horizontal sliding bar 232 and a second vertical sliding block 236 are arranged on the side wall of the vehicle roof 230, the second horizontal sliding bar 232 is located at the lower part of the vehicle roof 230, and the second vertical sliding block 236 is located at the front end of the vehicle roof 230.

Figure 4:
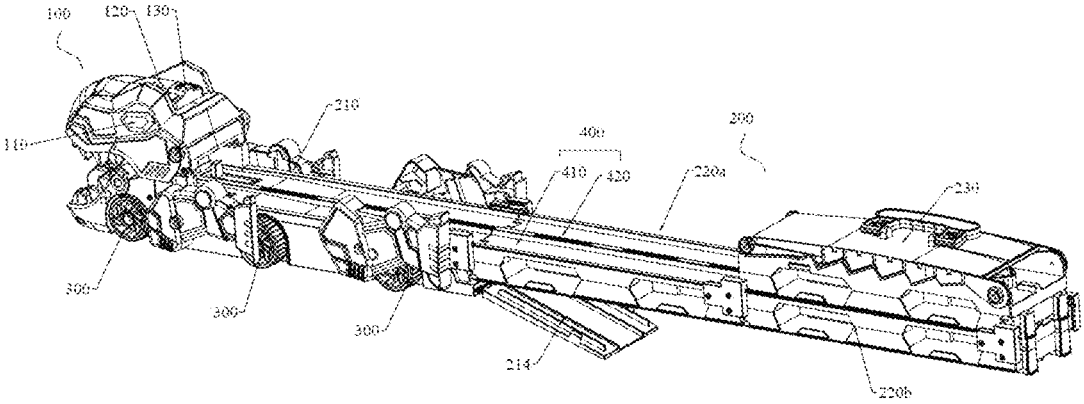
FIG. 4 is another schematic structural diagram of sliding in the pulling manner of the trailer portion of the toy transport vehicle according to the present invention.
Figure 5:
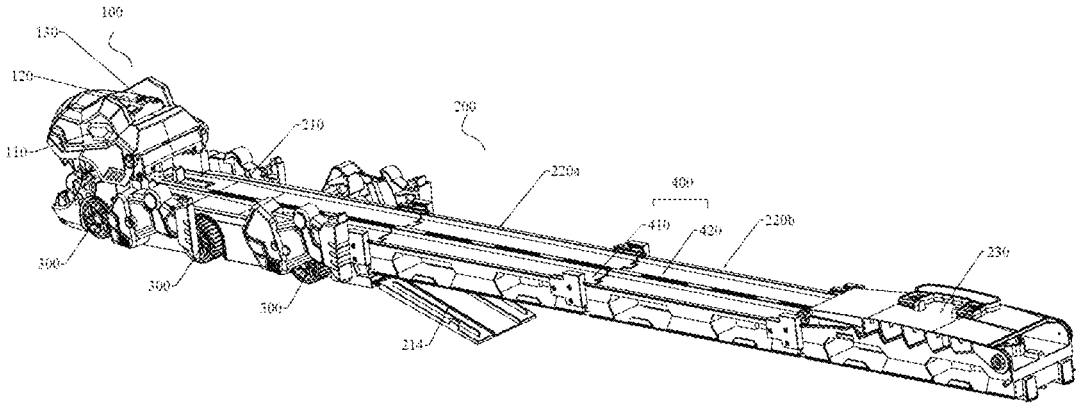
FIG. 5 is another schematic structural diagram of sliding in the pulling manner of the trailer portion of the toy transport vehicle according to the present invention.

When the toy transport vehicle is in the transport mode, the vehicle seat 210, the middle carriage 220 and the vehicle roof 230 can translate back and forth with each other, the first horizontal sliding bar 224 and the second horizontal sliding bar 232 are respectively inserted into the lower horizontal chute 501 of the connector 500 at corresponding positions, the first horizontal sliding bar 224 and the second horizontal sliding bar 232 are respectively connected with the lower horizontal chute 501 of the connector 500 at the corresponding positions in a sliding manner, and the first vertical block 225 and the second vertical sliding block 236 are respectively connected with the upper horizontal chute 502 of the connector 500 at the corresponding positions in the sliding manner; when the toy transport vehicle is switched from the transport mode to the runway mode, as the middle carriage 220 and the vehicle roof 230 are pulled, the vehicle roof 230 slides into the rear end of the middle carriage 220, the middle carriage 220 slides into the rear end of the vehicle seat 210, the first vertical sliding block 225 and the second vertical sliding block 236 slide into the upper horizontal chute 502 of the connector 500 at the corresponding positions at this time; further the middle carriage 220 and the vehicle roof 230 are pulled until the first vertical sliding block 225 and the second vertical sliding block 236 slide into the vertical chute 503 of the connector 500 at the corresponding positions, and then the middle carriage 220 and the vehicle roof 230 are pressed respectively to connect the vehicle seat 210, the middle carriage 220 and the vehicle roof 230 end to end to form the runway 400, thus completing the switching of the toy transport vehicle from the transport mode to the runway mode (FIG. 4, FIG. 5 and FIG. 16 show that the toy transport vehicle is in the runway mode.)

Further, in order to improve the sliding stability among the vehicle seat 210, the middle carriage 220 and the vehicle roof 230, one connector 500 is respectively arranged on the left side and the right side of the vehicle seat 210 and the middle carriage 220, the first horizontal sliding bar 224 and the first vertical sliding block 225 are symmetrically arranged on the left side wall and the right side wall of the middle carriage 220; and the second horizontal sliding bar 232 and the second vertical sliding block 236 are symmetrically arranged on the side wall of the vehicle roof 230. A first chute 211 is arranged at a center of a top of the vehicle seat 210, and a first bump 212 is arranged at the rear end thereof; a first sliding rail 227 is arranged at the center of the bottom of the middle carriage 220, a second chute 221 is arranged at the center of the top of the middle carriage 220, a second bump 222 is arranged at the front end of the middle carriage 220, and a first slot 223 is arranged at the rear end of the middle carriage 220; a second sliding rail 235 is arranged at the center of the bottom of the top carriage 231, and a second slot 237 is arranged at the rear end thereof. When the toy transport vehicle is in the transport mode, the first sliding rail 227 is inserted into the first chute 211 to realize the sliding connection between the vehicle seat 210 and the middle carriage 220; and the second sliding rail 235 is inserted into the second chute 221 to realize the sliding connection between the middle carriage 220 and the top carriage 231.

In order to realize the end-to-end connection among the vehicle seat 210, the middle carriage 220 and the vehicle roof 230, the first bump 212 is inserted into the first slot 223 to realize the end-to-end clamping between the vehicle seat 210 and the middle carriage 220; and the second bump 222 is inserted into the second slot 237 to realize the end-to-end clamping between the middle carriage 220 and the top carriage 231.

Further, in order to introduce the toy trolley from the runway 400 to the ground, as shown in FIG. 11 to FIG. 16, the vehicle roof 230 comprises the top carriage 231, a second extension plate 238 and a third extension plate 239 which are hinged with each other end to end, and the second horizontal sliding bar 232 and the second horizontal sliding block 236 are arranged on the side wall of the top carriage 231; the second extension plate 238 is provided with a handle 234; the second extension plate 238 and the third extension plate 239 are rotated to unfold as extension portions of the runway 400; at the same time, one end of the third extension plate 239 is hinged with the second extension plate 238, and the other end thereof is in contact with the ground, so that the toy trolley can be introduced from the runway 400 to the ground.

Figure 17:
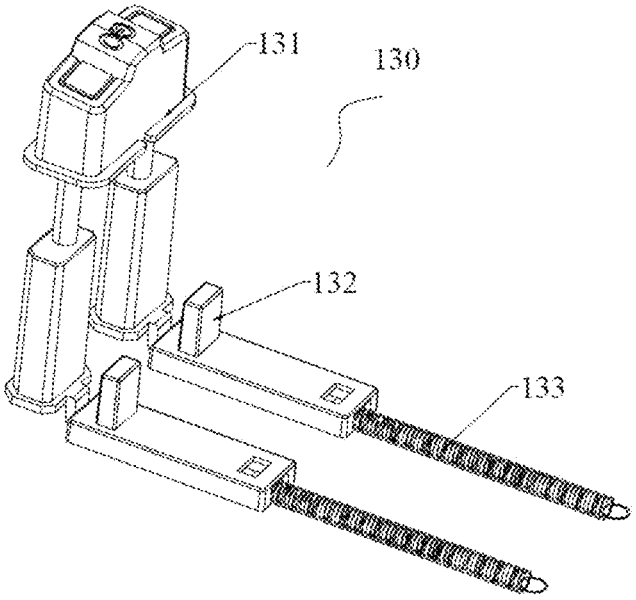
FIG. 17 is a schematic structural diagram of a transmitter of the toy transport vehicle according to the present invention.

Further, as shown in FIG. 17, the transmitter 130 comprises a press head 131, a trigger plate 132 and a spring 133, the press head 131 is arranged at the top of the dinosaur head, the trigger plate 132 is arranged at the front of the vehicle seat 210; one end of the spring 133 is fixedly connected with the vehicle seat 210, and the other end thereof is connected with the trigger plate 132, and the bottom of the press head 131 is clamped with the trigger plate 132. When the toy transport vehicle is in the runway mode, the vehicle seat 210, the middle carriage 220, the top carriage 231, the second extension plate 238 and the third extension plate 239 are unfolded to form the runway 400. The center of the runway 400 is provided with the first chute 211 and the second chute 221 to divide the runway into the left runway 410 and the right runway 420. The two toy trolleys are placed at the positions of the two trigger plates 132 respectively, the press head 131 is pressed downward with a force, so that the clamping of the press head 131 with the trigger plate 132 is released. At this time, under the action of the spring 133, the trigger plate 132 quickly moves to the back of the runway 400, thus providing an initial thrust for the toy trolley to run on the left runway 410 and the right runway 420.

Further, in order to store the toy trolleys in the trailer portion 200, a plurality of first cavities 226 are respectively opened in the middle carriage 220, a plurality of second cavities 233 are opened in the top carriage 231, and the toy trolleys are stored through the first cavities 226 and the second cavities 233.

Further, in order to improve the fun of the toy transport vehicle, the cab portion 100 is set in a shape of a dinosaur head, eyes of the dinosaur head are provided with luminous pieces 110, and a top of the dinosaur head is provided with a sounding piece 120; when the press head 131 is forced downward, the eyes of the dinosaur head emit light and sound (such as dinosaur cry, music sound, or knocking sound, etc.) at the same time, thus improving the interaction between the toy transport vehicle and children.

Figure 6:
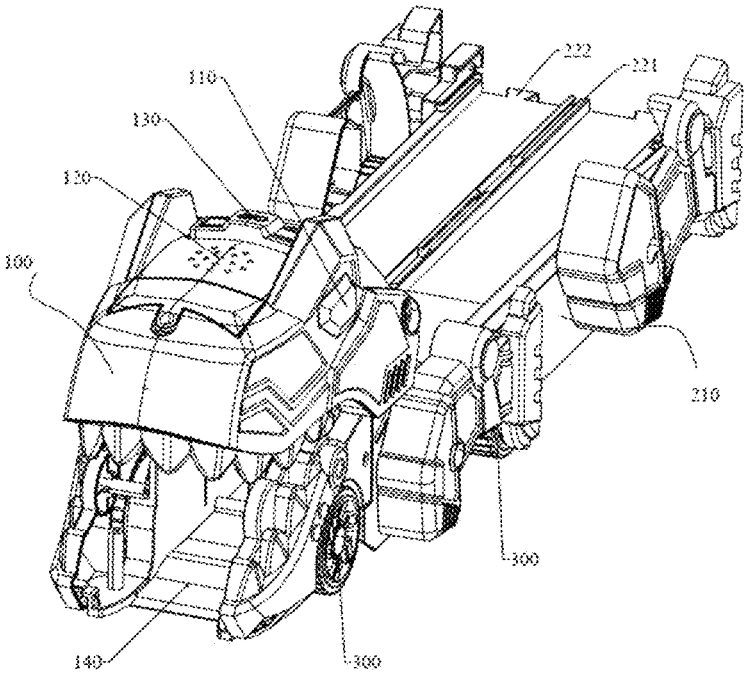
FIG. 6 is a schematic structural diagram of a cab portion and a vehicle seat of the toy transport vehicle according to the present invention.
Figure 7:
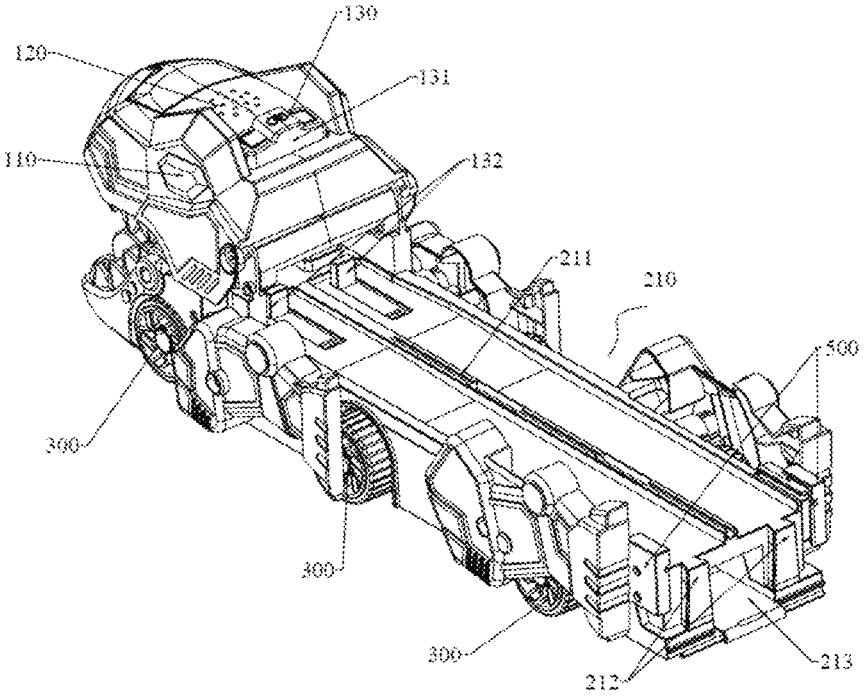
FIG. 7 is another schematic structural diagram of the cab portion and the vehicle seat of the toy transport vehicle according to the present invention.

Further, as shown in FIG. 6 and FIG. 7, a mouth of the dinosaur head is provided with an entrance 140, the bottom of the vehicle seat 210 is provided with a channel 213, and the entrance 140 is communicated with the channel 213. By pushing the toy transport vehicle, the toy trolley enters through the entrance 140 and then slides out of the channel 213, which simulates a state that the dinosaur head devours the trolley.

Working Principle

Figure 2:
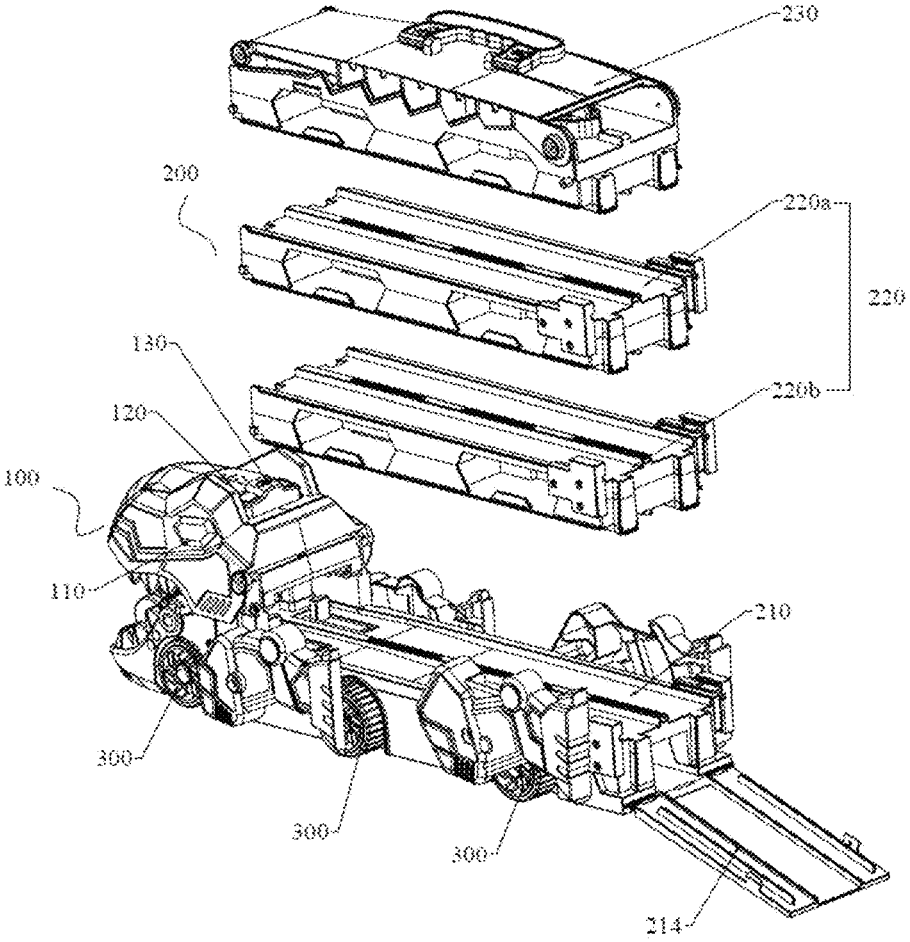
FIG. 2 is a schematic diagram of an explosion structure of the toy transport vehicle in the transport mode according to the present invention.
Figure 3:
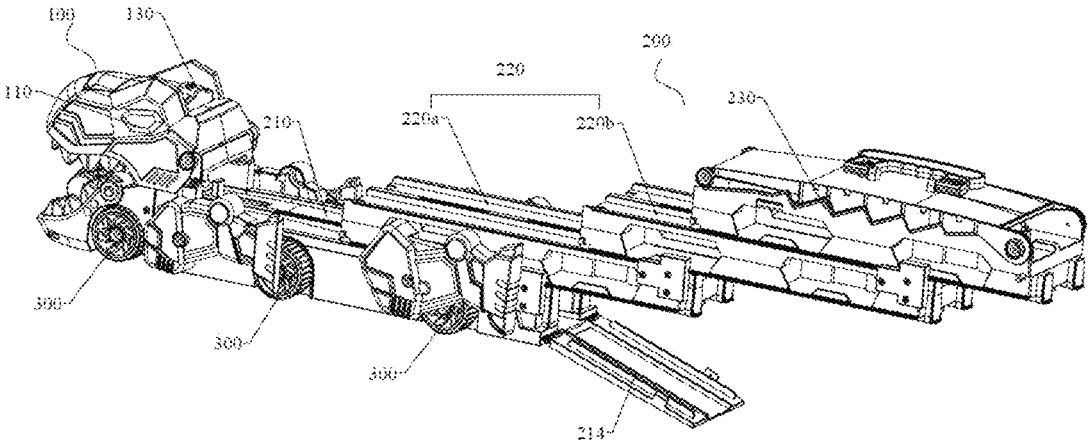
FIG. 3 is a schematic structural diagram of sliding in a pulling manner of a trailer portion of the toy transport vehicle according to the present invention.

When the toy transport vehicle is in the transport mode, FIG. 1 and FIG. 2 show that the vehicle seat 210, the middle carriage 220 and the vehicle roof 230 are orderly stacked from bottom to top, and the tail plate 214 contacts with tail parts of the middle carriage 220 and the vehicle roof 230 to prevent the vehicle seat 210, the middle carriage 220 and the vehicle roof 230 from sliding. One toy trolley is placed at the entrance 140 of the dinosaur head, and the toy transport vehicle is pushed to make the toy trolley enter from the entrance 140, and then slide out of the channel 213, which simulates the mode that the dinosaur head devours the trolley;

As shown in FIG. 4, FIG. 5 and FIG. 16, when the toy transport vehicle is switched from the transport mode to the runway mode, the middle carriage 220 and the vehicle roof 230 are pulled, so that the vehicle roof 230 slides into the rear end of the middle carriage 220, and the middle carriage 220 slides into the rear end of the vehicle seat 210. At this time, the first vertical sliding block 225 and the second vertical sliding block 236 slide into the upper horizontal chute 502 of the connector 500 at corresponding positions. The middle carriage 220 and the vehicle roof 230 are further pulled until the first vertical sliding block 225 and the second vertical sliding block 236 slide into the vertical chute 503 of the connector 500 at the corresponding positions, and then the middle carriage 220 and the vehicle roof 230 are pressed respectively to connect the vehicle seat 210, the middle carriage 220 and the vehicle roof 230 end to end to form the runway 400, thus completing the switching of the toy transport vehicle from the transport mode to the runway mode. At the same time, the second extension plate 238 and the third extension plate 239 are rotated to unfold as the extension portions of the runway 400, and one end of the third extension plate 239 is in contact with the ground to facilitate the introduction of the toy trolley from the runway 400 to the ground.

As shown in FIG. 16, two toy trolleys are placed at the positions of the trigger plates 132 of the left runway 410 and the right runway 420 respectively, and the press head 131 is forced downward. Under the action of the spring 133, the trigger plate 132 quickly moves to the back of the runway 400, thus providing an initial thrust for the toy trolleys to drive on the left runway 410 and the right runway 420 respectively, and observing which toy trolley drives out of the runway first. The fun of play is improved by the competition of the two toy trolleys.

Embodiment 2

The difference between this embodiment and Embodiment 1 is that the trailer portion 200 only comprises the vehicle seat 210 and the vehicle roof 230, and no middle carriage 220 (not shown) is provided, and the vehicle seat 210 and the vehicle roof 230 are slidably connected with each other in the pulling manner; and by pulling the vehicle roof 230, the toy transport vehicle can be switched between the transport mode and the runway mode. The vehicle seat 210 and the vehicle roof 230 are orderly stacked from bottom to top in the transport mode, and the vehicle roof 230 serves the purpose of storing the toy trolleys. The tail of the vehicle seat 210 is hinged with the tail plate 214. The vehicle seat 210 and the vehicle roof 230 are connected with each other end to end in the runway mode, and are unfolded into the linear runway 400 (which is realized by pulling the vehicle roof 230).

It should be noted that in this specification, relational terms such as first and second are only used for distinguishing one entity or operation from another entity or operation, and do not necessarily require or imply that there is any such actual relationship or order between these entities or operations. What is not described in detail in the specification shall belong to the prior art known to those skilled in the art.

The above is only the preferred embodiment of the present invention, and does not limit the present invention in any form; any ordinary technician in the industry can smoothly implement the present invention as shown in the drawings and described above; however, any equivalent changes made by those familiar with this field by using the technical contents disclosed above without departing from the scope of the technical solution of the present invention are equivalent embodiments of the present invention; meanwhile, any equivalent changes, modifications and evolutions made to the above embodiments according to the essential technology of the present invention shall still fall within the protection scope of the technical solution of the present invention.

I claim:

1. A deployable toy transport vehicle, comprising a cab portion and a trailer portion, the trailer portion comprising a vehicle seat, a middle carriage and a vehicle roof, the vehicle seat, the middle carriage and the vehicle roof being slidably connected with each other in a pulling manner, and the cab portion comprising a transmitter of a toy trolley;

wherein the toy transport vehicle is switched between a transport mode and a runway mode by pulling the middle carriage and the vehicle roof, the vehicle seat, the middle carriage and the vehicle roof are orderly stacked from bottom to top in the transport mode; and the vehicle seat, the middle carriage and the vehicle roof are connected end to end in the runway mode and are unfolded into a linear runway;

wherein connectors are arranged at rear ends of the vehicle seat and the middle carriage, the middle carriage is slidably connected with the connector arranged on the vehicle seat, and the vehicle roof is slidably connected with the connector arranged on the middle carriage; wherein, the connectors are used for guiding the middle carriage and the vehicle roof to translate horizontally and vertically;

wherein each connector comprises a lower horizontal chute, an upper horizontal chute and a vertical chute, and the vertical chute is communicated with the lower horizontal chute and the upper horizontal chute;

wherein a first horizontal sliding bar and a first vertical sliding block are arranged on a side wall of the middle carriage, and the first vertical sliding block is located at a front end of the middle carriage;

a second horizontal sliding bar and a second vertical sliding block are arranged on a side wall of the vehicle roof, and the second vertical sliding block is located at a front end of the vehicle roof;

when the toy transport vehicle is in the transport mode, the first horizontal sliding bar is slidably connected with the lower horizontal chute of the connector of the vehicle seat, and the second horizontal sliding bar is slidably connected with the lower horizontal chute of the connector of the middle carriage; and the first vertical sliding block is slidably connected with the upper horizontal chute of the connector of the vehicle seat, and the second vertical sliding block is slidably connected with the upper horizontal chute of the connector of the middle carriage; and when the toy transport vehicle is in the runway mode, the first vertical sliding block slides into the vertical chute of the connector of the vehicle seat, and the second vertical sliding block slides into the vertical chute of the connector of the middle carriage.

2. The deployable toy transport vehicle according to claim 1, wherein the middle carriage comprises at least one carriage slidably connected between the vehicle seat and the vehicle roof.

3. The deployable toy transport vehicle according to claim 1, wherein the connector of the vehicle seat is formed as a pair of connectors respectively arranged on a left side and a right side of the vehicle seat, the connector of the middle carriage is formed as a pair of connectors respectively arranged on a left side and a right side of the middle carriage, the first horizontal sliding bar is formed as a pair of horizontal sliding bars respectively arranged on a left side wall and a right side wall of the middle carriage, the first vertical sliding block is formed as a pair of vertical sliding blocks respectively arranged on the left side wall and the right side wall of the middle carriage, the second horizontal sliding bar is formed as a pair of horizontal sliding bars respectively arranged on a left side wall and a right side wall of the vehicle roof, and the second vertical sliding block is formed and a pair of vertical sliding blocks respectively arranged on the left side wall and the right side wall of the vehicle roof.

4. The deployable toy transport vehicle according to claim 1, wherein wheels are arranged at bottoms of the cab portion and the trailer portion.

5. The deployable toy transport vehicle according to claim 1, wherein the cab portion is in a shape of a dinosaur head, eyes of the dinosaur head are provided with luminous pieces, a top of the dinosaur head is provided with a sounding piece, a mouth of the dinosaur head is provided with an entrance, a channel is arranged at the bottom of the vehicle seat, and the entrance is communicated with the channel.

6. The deployable toy transport vehicle according to claim 5, wherein the transmitter comprises a press head, a trigger plate and a spring, the press head is arranged at the top of the dinosaur head, the trigger plate is arranged at the front of the vehicle seat, one end of the spring is fixedly connected with the vehicle seat, and the other end thereof is connected with the trigger plate, and a bottom of the press head is connected with the trigger plate in a clamping manner.

7. The deployable toy transport vehicle according to claim 1, wherein the vehicle roof comprises a top carriage, a second extension plate and a third extension plate which are hinged with each other end to end, the second horizontal sliding bar and the second vertical sliding block are arranged on a side wall of the top carriage; and the second extension plate is provided with a handle.

* * * * *